US005108031A

United States Patent [19]

Watson

[11] Patent Number: 5,108,031

[45] Date of Patent: Apr. 28, 1992

[54] CORNER REINFORCEMENT APPARATUS

[76] Inventor: Michael J. Watson, 1843 15th Ave. N., Lake Worth, Fla. 33460

[21] Appl. No.: 729,189

[22] Filed: Jul. 12, 1991

[51] Int. Cl.[5] ..... B65D 5/42

[52] U.S. Cl. ..... 229/199; 206/813; 229/198.1; 248/151

[58] Field of Search ..... 229/104, 198.1, 199, 229/918, 919, DIG. 11; 248/151, 220.1, 911; 206/813

[56] References Cited

U.S. PATENT DOCUMENTS

| | | | |
|---|---|---|---|
| 754,537 | 3/1904 | Bower | 229/199 |
| 886,462 | 5/1908 | Amos | 229/199 |
| 995,942 | 6/1911 | Bain | 248/151 |
| 1,104,234 | 7/1914 | Weiss | 229/199 |
| 1,622,506 | 3/1927 | Graves | 248/151 |
| 2,229,395 | 1/1941 | Stock | 229/199 |
| 2,517,125 | 8/1950 | Ludwig | 248/151 |

FOREIGN PATENT DOCUMENTS

| | | | |
|---|---|---|---|
| 738997 | 3/1970 | Belgium | 229/918 |
| 2804406 | 8/1979 | Fed. Rep. of Germany | 229/DIG. 11 |
| 853769 | 3/1940 | France | 229/199 |
| 1267128 | 6/1961 | France | 229/DIG. 11 |

*Primary Examiner*—Gary E. Elkins
*Attorney, Agent, or Firm*—Leon Gilden

[57] ABSTRACT

A corner reinforcement bracket structure is arranged for fixed securement to a corner portion of a container lid or container itself to provide reinforcement and geometric integrity to the structure of the container and reinforcement bracket. The bracket includes a plurality of integrally and orthogonally mounted plates, with a connecting web orthogonally mounted to an upper end of each plate coextensively therewith.

3 Claims, 4 Drawing Sheets

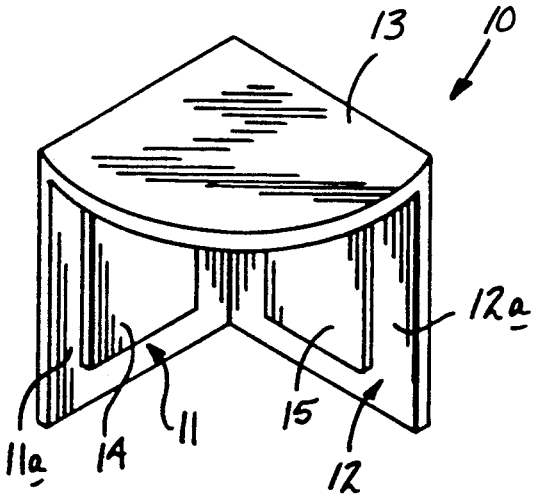
Fig 1
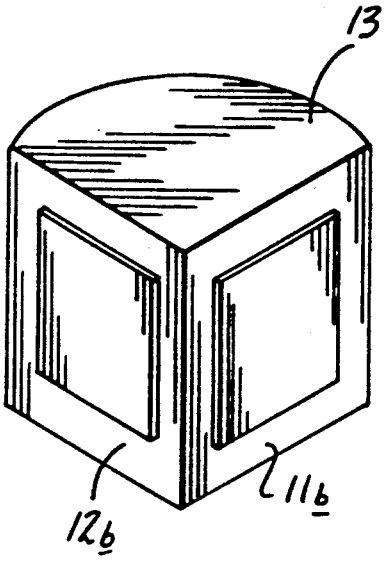
Fig 2
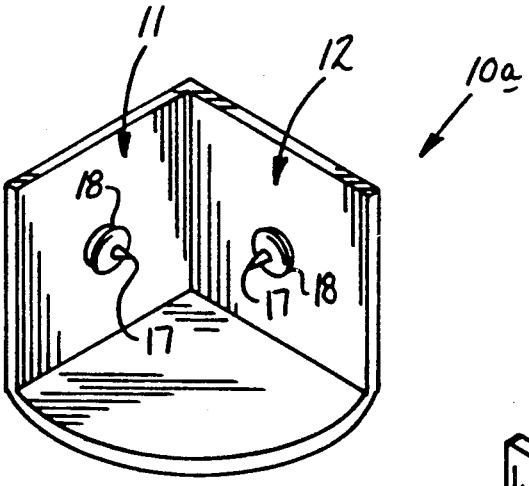
Fig 3
Fig 4
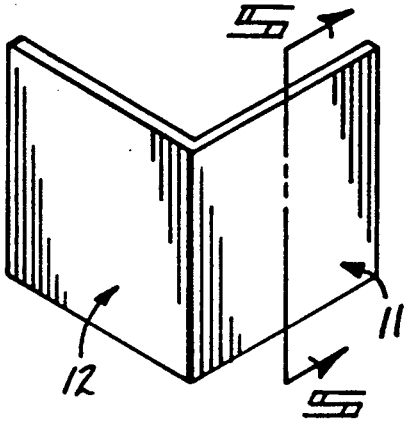

CORNER REINFORCEMENT APPARATUS

BACKGROUND OF THE INVENTION

1. Field of the Invention

The field of invention relates to corner reinforcement apparatus, and more particularly pertains to a new and improved corner reinforcement apparatus wherein the same is arranged for securement to corner portions of a container box or lid to enhance its geometric integrity.

2. Description of the Prior Art

Corner reinforcement structure is utilized in containers, as containers typically formed of pasteboard and the like are of a semi-flexible construction and after continuous use or subjection to manipulation, the container structure tends to fail. Prior art corner reinforcement apparatus is exemplified by U.S. Pat. No. 4,787,553 to Hoskins wherein a corner fastening device includes associated pins and rearwardly spaced plate members projected over confronting edges of a corner in a container organization.

U.S. Pat. No. 4,068,796 to Kullman, Jr. sets forth a container formed with integral corner posts to provide reinforcement to the container.

U.S. Pat. No. 3,545,666 to Visvydas sets forth a container including corner posts integrally formed to the container to provide corner reinforcement thereto.

U.S. Pat. No. 4,799,620 to Vilella sets forth a corner construction formed as triangular insert members mounted to the corner portions of associated containers.

Accordingly, it may be appreciated that there continues to be a need for a new and improved corner reinforcement apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of corner reinforcement apparatus now present in the prior art, the present invention provides a corner reinforcement apparatus wherein the same is arranged for retrofit to an associated corner structure of a container or lid. As such, the general purpose of the present invention, which will be described subsequently in greater detail, is to provide a new and improved corner reinforcement apparatus which has all the advantages of the prior art corner reinforcement apparatus and none of the disadvantages.

To attain this, the present invention provides a corner reinforcement bracket structure arranged for fixed securement to a corner portion of a container lid or container itself to provide reinforcement and geometric integrity to the structure of the container and reinforcement bracket. The bracket includes a plurality of integrally and orthogonally mounted plates, with a connecting web orthogonally mounted to an upper end of each plate coextensively therewith.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner reinforcement apparatus which has all the advantages of the prior art corner reinforcement apparatus and none of the disadvantages.

It is another object of the present invention to provide a new and improved corner reinforcement apparatus which may be easily and efficiently manufactured and marketed.

It is a further object of the present invention to provide a new and improved corner reinforcement apparatus which is of a durable and reliable construction.

An even further object of the present invention is to provide a new and improved corner reinforcement apparatus which is susceptible of a low cost of manufacture with regard to both materials and labor, and which accordingly is then susceptible of low prices of sale to the consuming public, thereby making such corner reinforcement apparatus economically available to the buying public.

Still yet another object of the present invention is to provide a new and improved corner reinforcement apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric frontal view of the instant invention.

FIG. 2 is an isometric rear view of the instant invention.

FIG. 3 is an isometric frontal view of a modification of the corner structure of the invention.

FIG. 4 is an isometric rear view of the corner structure of the invention, as illustrated in FIG. 3.

FIG. 12 is an isometric illustration of the modification of the invention, as illustrated in FIG. 8, in use with a lid structure.

DESCRIPTION OF THE PREFERRED EMBODIMENT

Figure 5:
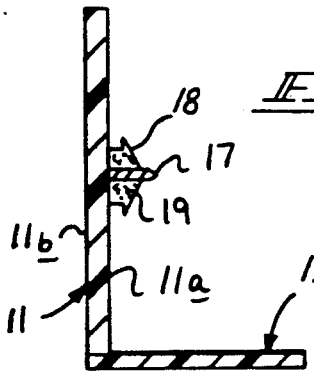
FIG. 5 is an orthographic view, taken along the lines 5—5 of FIG. 4 in the direction indicated by the arrows.

With reference now to the drawings, and in particular to FIGS. 1 to 12 thereof, a new and improved corner reinforcement apparatus embodying the principles and concepts of the present invention and generally designated by the reference numerals 10, 10*a*, and 10*b* will be described.

Figure 6:
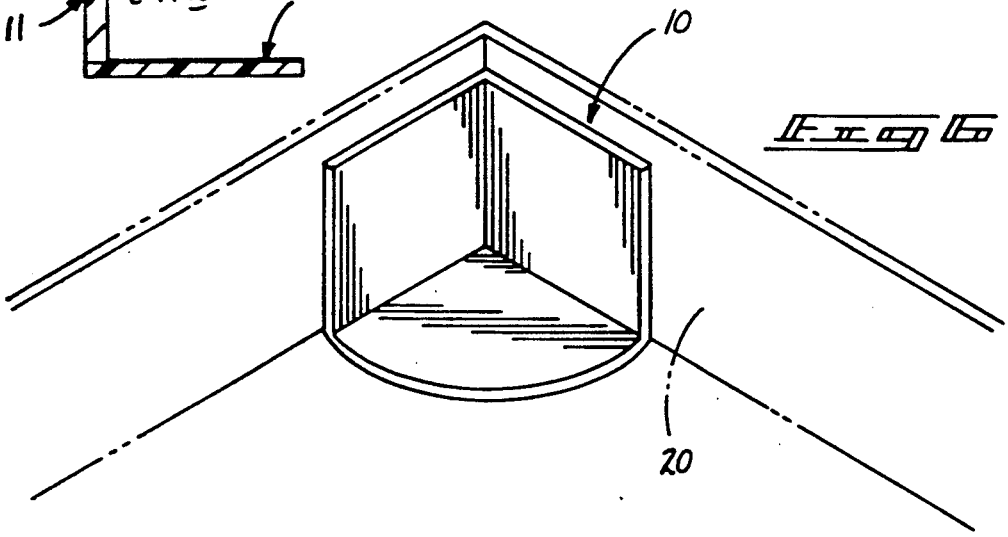
FIG. 6 is an isometric illustration of the apparatus in use mounted to a container.
Figure 7:
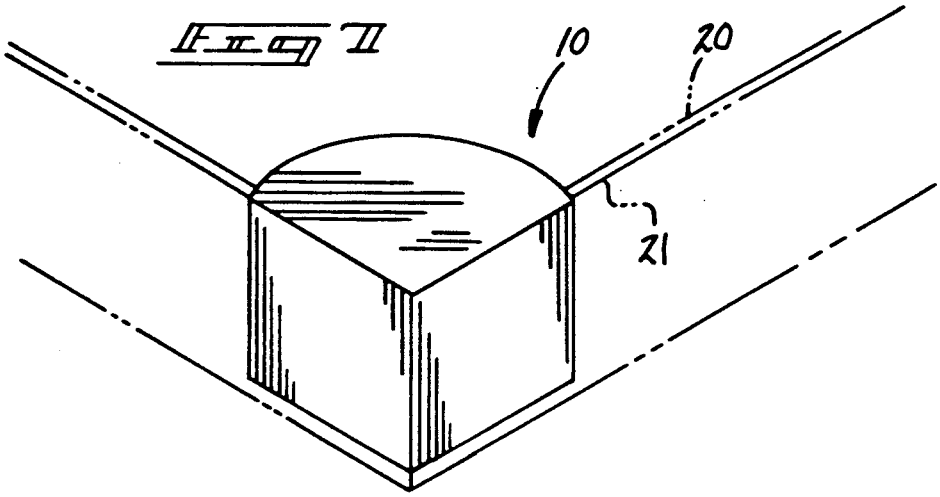
FIG. 7 is an isometric illustration of the invention mounted to a lid in association with a container.
Figure 8:
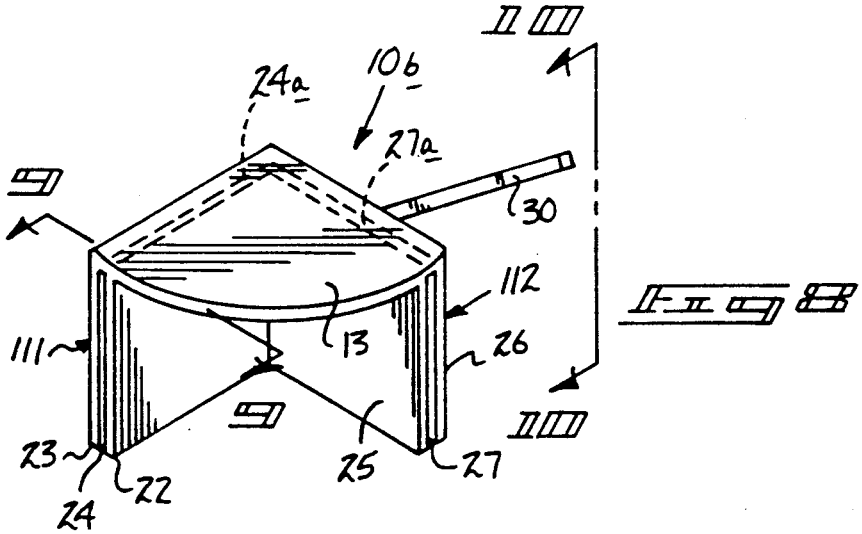
FIG. 8 is an isometric illustration of a modification of the invention.
Figure 9:
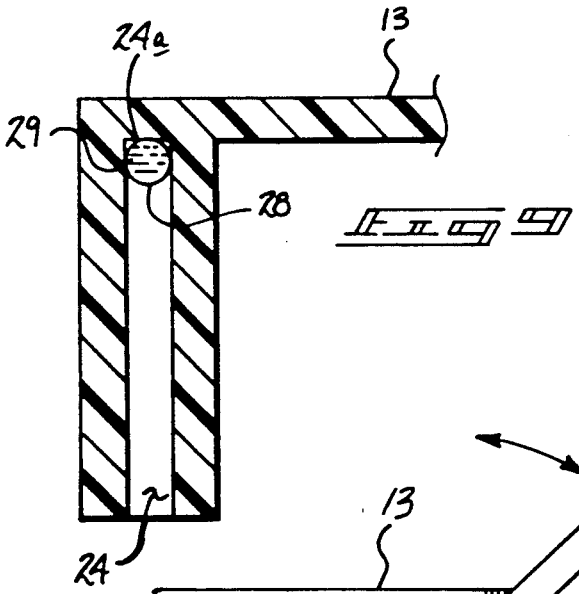
FIG. 9 is an orthographic view, taken along the lines 9—9 of FIG. 8 in the direction indicated by the arrows.
Figure 10:
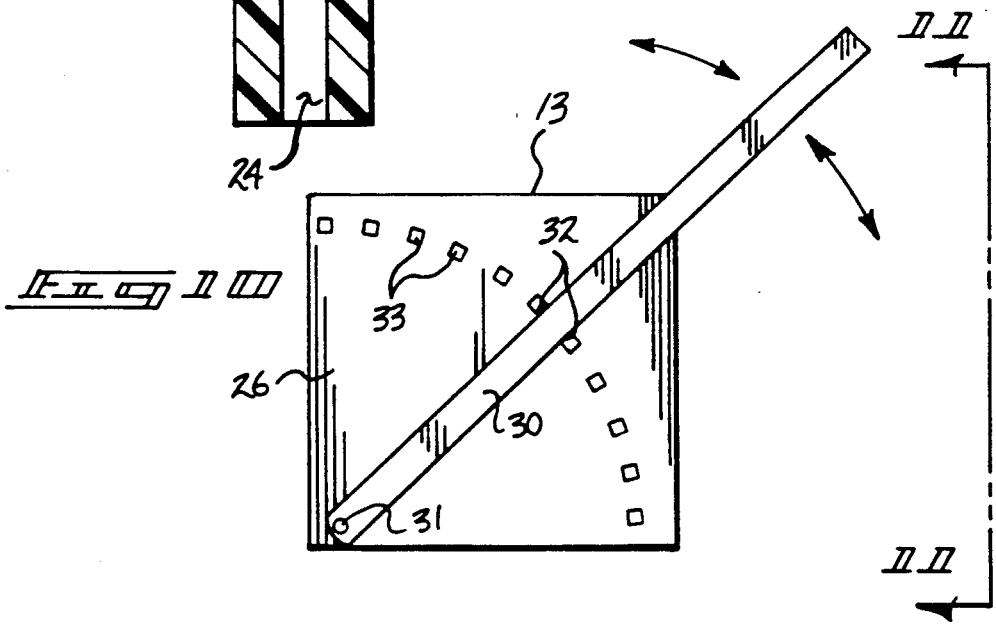
FIG. 10 is an orthographic view, taken along the lines 10—10 of FIG. 8 in the direction indicated by the arrows.
Figures 11, 11A:
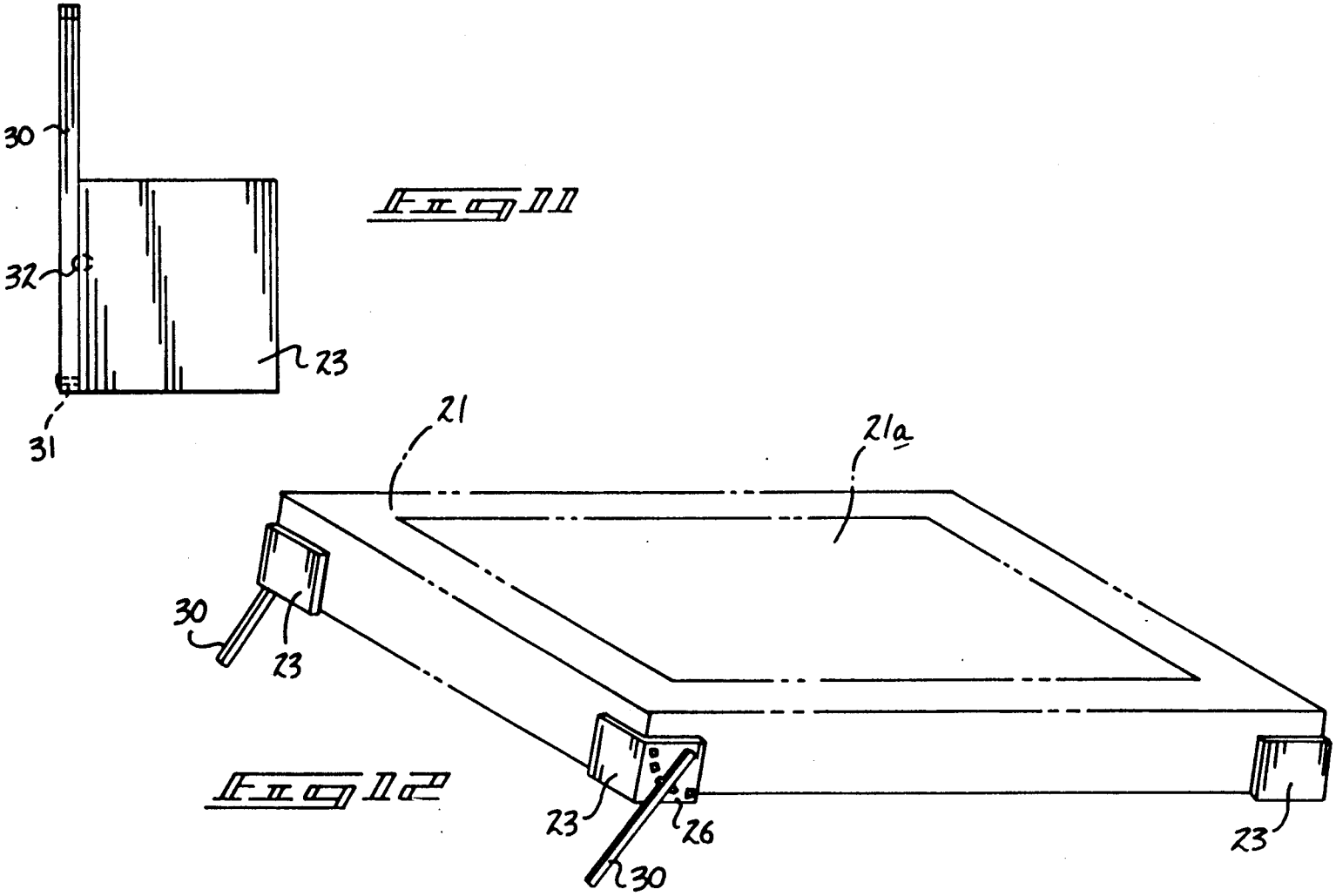
FIG. 11 is an orthographic view, taken along the lines 11—11 of FIG. 10 in the direction indicated by the arrows.

More specifically, the corner reinforcement apparatus 10 of the instant invention essentially comprises a first rigid plate 11 fixedly and orthogonally mounted to a second rigid plate 12 in an edge-to-edge relationship to define an "L" shaped configuration and including a first plate interior surface 11*a* and a first plate exterior surface 11*b*, with a second plate interior surface 12*a* and a second plate exterior surface 12*b*. The plates include upper and lower respective ends, with a connecting web 13 orthogonally mounted coextensively to the upper ends of the first and second rigid plates 11 and 12. A respective first and second adhesive web 14 and 15 is mounted to the respective first and second plate interior surface 11*a* and 12*a* for securement to a container, in a manner as illustrated in FIG. 6, or to a lid, in a manner as illustrated in FIG. 7.

The apparatus 10*a*, as illustrated in FIGS. 3 and 4, utilize the first and second plates 11 and 12, with each respective interior surface including a rigid projection spike 17 orthogonally mounted medially of each interior surface for projection to enhance securement of the bracket structure to an associated container or lid, wherein an adhesive capsule 18 is positioned on the interior surface in surrounding relationship relative to the associated spike 17, with the adhesive capsule 18 filled with a fluid adhesive 19. Upon projection of the apparatus onto a container or lid, the adhesive capsules 18 are burst and the associated fluid enhancing securement of the apparatus to the container structure.

FIGS. 8-12 illustrate a further modified apparatus 10*b* that includes a first web member 111 fixedly and orthogonally mounted to a second web member to define the "L" shaped configuration to include the connecting web 13 fixedly and orthogonally mounted to an upper terminal end of the "L" shaped bracket thusly formed. The first web member 111 includes a first interior wall 22 spaced from and parallel a first exterior wall 23 defining a first cavity slot 24. The cavity slot 24 includes a cavity roof 24*a*, wherein the second web member 112 includes a second exterior wall 26 spaced from and parallel a second interior wall 25 defining the second cavity slot 27 therewithin defined between the interior and exterior walls 25 and 26, wherein the first cavity slot and the second cavity slot intersect and are in communication with one another, and further the second cavity slot 27 is defined by a second cavity slot roof 27*a*. The first and second cavity slot roofs 24*a* and 27*a* each include a flexible adhesive capsule 28 mounted to each roof, including a fluid adhesive 29 contained therewithin. Upon projection of the slots 24 and 27 over a container or lid side wall webs at a corner thereof, the fluid adhesive capsules 28 are burst to release an adhesive to ensure securement of the first and second web members 111 and 112 thereto. A support leg 30 is pivotally mounted to each second exterior wall 26 by means of a pivot axle 31 that pivots about a pivot axle 31 over the second exterior wall 26 exterior surface projecting beyond the second exterior wall 26. The support leg 30 includes a plurality of projecting pegs 32 mounted to the sides of the support leg 30 spaced apart a predetermined spacing, wherein the second exterior wall 26 includes a semi-circular array of openings 33 defined about a radial center coincident with the pivot axle 31. In this manner when mounted to a lid or container such as illustrated in FIG. 12, the support legs 30 project beyond the connecting web 30 to provide raised support for the lid, such as in use with puzzle boxes, to lift the lid for visual observation of the puzzle box picture mounted upon the lid top wall 21*a*. This lifting of the lid enhances enjoyment and use of the puzzle and ease of viewing of the finished solution that is typically imprinted upon the lid top walls 21*a* of such organizations. Further, the reinforcement apparatus 10*b* is easily retrofitted to puzzle box lids or containers, as illustrated in FIG. 12, and should this structure be applied to the lid only, the connecting web 13 may be deleted, whereupon when used with the container, the web enhances the geometric integrity of the box in use.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner reinforcement apparatus, comprising, a first web member fixedly and orthogonally mounted to a second web member in an edge-to-edge relationship to define an "L" shaped bracket, the first web member includes a first upper edge, and the second web member includes a second upper edge, and a connecting web fixedly, orthogonally, and coextensively mounted to the first and second upper edges, and wherein the first web member includes a first planar interior wall spaced from and parallel a first planar exterior wall defining a first cavity slot coextensively therebetween, with the cavity slot including a first cavity slot roof, and the second web member including a second planar interior wall spaced from and parallel a second exterior wall, with a second cavity slot defined coextensively therebetween, wherein the second cavity slot includes a second cavity slot roof, wherein the first cavity slot and the second cavity slot intersect and communicate with one another, and wherein the first cavity slot roof and the second cavity slot roof each include a flexible adhesive capsule fixedly mounted thereto, wherein each capsule includes a fluid adhesive contained therewithin.

2. An apparatus as set forth in claim 1 wherein the second planar exterior wall includes a support leg pivotally mounted thereto.

3. An apparatus as set forth in claim 2 including a pivot axle pivotally mounting the support leg to the second exterior wall, where the support leg extends beyond the connecting web, and the support leg includes a plurality of projecting pegs projecting orthogonally relative to the second exterior wall and oriented parallel to the pivot axle, and a semi-circular array of openings directed into the second exterior wall, wherein the projecting pegs are spaced from the pivot axle a predetermined radius and the semi-circular array of openings are defined about the pivot axle along a predetermined radius, wherein adjacent openings are spaced apart a predetermined spacing, wherein the projecting pegs are positioned within a plurality of adjacent openings to adjustably orient the support leg relative to the second exterior wall for lifting a container lid corner positioned within the first cavity slot and the second cavity slot.

* * * * *